United States Patent [19]

Arfert et al.

[11] Patent Number: 4,793,510

[45] Date of Patent: Dec. 27, 1988

[54] RESEALABLE CONTAINER CLOSURE

[75] Inventors: Horst F. W. Arfert; Daniel F. Cudzik, both of Chesterfield County; Roger H. Donaldson, Lancaster County, Va.

[73] Assignee: Reynolds Metals Company, Richmond, Va.

[21] Appl. No.: 73,080

[22] Filed: Jul. 13, 1987

[51] Int. Cl.[4] ..... B65D 41/16; B65D 41/18

[52] U.S. Cl. ..... 220/306; 220/309; 220/260; 215/320; 215/321

[58] Field of Search ..... 220/260, 306, 309, 254, 220/380, 307; 215/272, 320, 321; 150/55

[56] References Cited

U.S. PATENT DOCUMENTS

| | | | |
|---|---|---|---|
| Re. 25,906 | 11/1965 | Livingstone . | |
| 1,201,082 | 10/1916 | Nussbaumer . | |
| 1,546,159 | 7/1925 | Wippler . | |
| 1,613,826 | 1/1927 | Hind . | |
| 1,902,892 | 3/1933 | Pattenger . | |
| 1,946,981 | 2/1934 | Lower . | |
| 2,004,852 | 6/1935 | Coyle . | |
| 2,036,858 | 4/1936 | Sacks . | |
| 2,084,084 | 6/1937 | Greer | 220/90 |
| 2,168,734 | 8/1939 | Freeman . | |
| 2,208,899 | 7/1940 | Freeman . | |
| 2,215,392 | 11/1940 | Freeman . | |
| 2,303,773 | 12/1942 | Freeman . | |
| 2,393,578 | 1/1946 | Waite . | |
| 2,486,364 | 10/1949 | Simmons . | |
| 2,614,727 | 10/1952 | Robinson . | |
| 2,620,938 | 12/1952 | Jesnig . | |
| 2,639,058 | 5/1953 | Lobl . | |
| 2,704,100 | 3/1955 | Freeman . | |
| 2,711,840 | 6/1955 | Gits et al. | 220/42 |
| 2,776,691 | 1/1957 | Tupper . | |
| 2,819,748 | 1/1958 | Cataleno . | |
| 2,869,746 | 1/1959 | Wilcox . | |
| 2,922,563 | 1/1960 | Aldington . | |
| 3,074,578 | 1/1963 | Hester . | |
| 3,352,448 | 11/1967 | Livingstone . | |
| 3,486,665 | 12/1969 | Le Croce . | |
| 3,527,375 | 9/1970 | Klein . | |
| 3,589,551 | 6/1971 | Hoggbom . | |
| 3,606,074 | 9/1971 | Hayes . | |
| 3,628,542 | 12/1971 | Drew . | |
| 3,642,167 | 2/1972 | Kinney . | |
| 3,688,942 | 9/1972 | Mitchell et al. . | |
| 3,727,787 | 4/1973 | Gregory . | |
| 3,907,158 | 9/1975 | Frankenberg | 220/252 |
| 3,994,410 | 11/1976 | Pirgov et al. | 215/320 |
| 4,061,244 | 12/1977 | Tucker | 220/310 |
| 4,094,460 | 6/1978 | Scanga et al. . | |
| 4,106,662 | 8/1978 | Strobe et al. | 220/268 |
| 4,113,134 | 9/1978 | Heintzelman | 220/256 |
| 4,262,815 | 4/1981 | Klein | 220/273 |
| 4,291,813 | 9/1981 | Allen et al. | 215/252 |
| 4,301,941 | 11/1981 | Kraft | 220/306 |
| 4,341,324 | 7/1982 | Ramirez | 220/306 |
| 4,356,929 | 11/1982 | Müller-Kühn et al. | 220/270 |
| 4,376,493 | 3/1983 | Gall | 220/307 |
| 4,387,820 | 6/1983 | Ignell | 215/320 |
| 4,399,924 | 8/1983 | Nilsson | 220/257 |
| 4,465,205 | 8/1984 | Sutch | 220/309 |
| 4,487,326 | 12/1984 | Uhlig | 215/307 |
| 4,574,975 | 3/1986 | Taylor et al. | 220/306 |

FOREIGN PATENT DOCUMENTS

| | | |
|---|---|---|
| 1924472 | 11/1969 | Fed. Rep. of Germany . |
| 2718692 | 11/1977 | Fed. Rep. of Germany . |

(List continued on next page.)

*Primary Examiner*—George T. Hall

*Attorney, Agent, or Firm*—Alan T. McDonald

[57] ABSTRACT

A resealable closure device for use on metallic cans includes a metallic end wall having an opening surrounded by an upwardly extending and outwardly flaring beaded flange. The flexible closure element includes a central panel, a lever portion and a connecting portion connecting the lever portion to the central panel; the closure device is molded in an inverted umbrella position which is capable of being inverted to engage the flange of the opening; a skirt portion is provided on the interior side of the central panel of the flexible closure element to provide a degree of resistance to removal of the closure device from the opening by user.

62 Claims, 3 Drawing Sheets

OTHER PUBLICATIONS

| | | |
|---|---|---|
| 7801717 | 5/1978 | Fed. Rep. of Germany . |
| 2814594 | 10/1979 | Fed. Rep. of Germany . |
| 826555 | 11/1981 | Fed. Rep. of Germany . |
| 3216868 | 1/1983 | Fed. Rep. of Germany . |
| 3207198 | 9/1983 | Fed. Rep. of Germany . |
| 3208994 | 9/1983 | Fed. Rep. of Germany . |
| 8228681 | 10/1983 | Fed. Rep. of Germany . |
| 368095 | 11/1906 | France . |
| 828633 | 5/1937 | France . |
| 828967 | 6/1938 | France . |
| 836941 | 1/1939 | France . |
| 1023521 | 3/1953 | France . |
| 1149455 | 12/1957 | France . |
| 1216506 | 4/1960 | France . |
| 1370442 | 10/1963 | France . |
| 1505614 | 11/1967 | France . |
| 2377333 | 8/1978 | France . |
| 2427956 | 1/1980 | France . |
| 677495 | 8/1980 | France . |
| 2464196 | 3/1981 | France . |
| 2499029 | 8/1982 | France . |
| 144746 | 11/1980 | German Democratic Rep. . |
| 74121 | 9/1953 | Netherlands . |
| 109104 | 6/1925 | Switzerland . |
| 193582 | 10/1927 | Switzerland . |
| 465368 | 8/1937 | United Kingdom . |
| 693027 | 6/1953 | United Kingdom . |
| 1054334 | 1/1967 | United Kingdom . |
| 1054335 | 1/1967 | United Kingdom . |
| 1282754 | 7/1972 | United Kingdom . |
| 1389747 | 4/1975 | United Kingdom . |
| 1407601 | 9/1975 | United Kingdom . |
| 1438136 | 6/1976 | United Kingdom . |
| 2021532 | 12/1979 | United Kingdom . |
| 2091706 | 8/1982 | United Kingdom . |
| 2122587 | 1/1984 | United Kingdom . |

Fig. 3
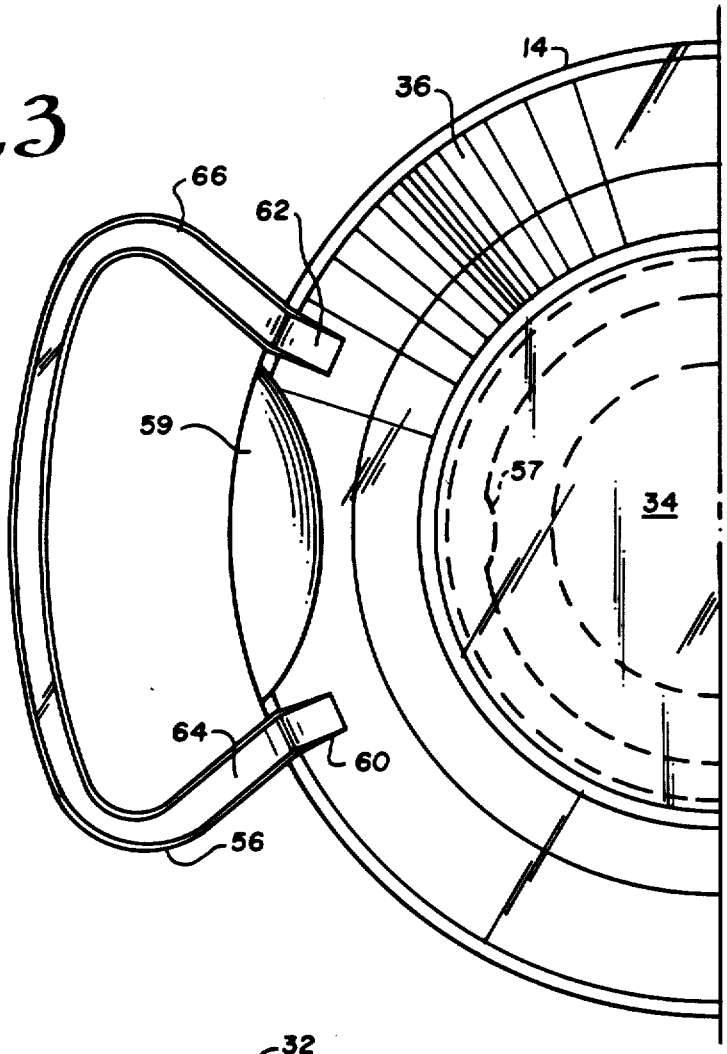
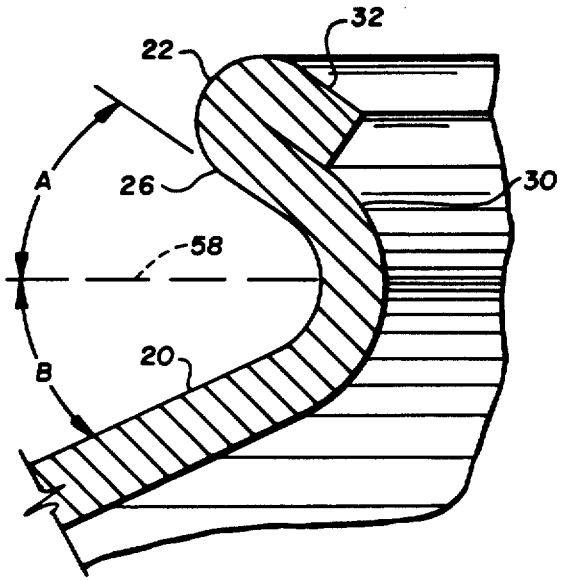
Fig. 5

RESEALABLE CONTAINER CLOSURE

RELATED PATENT

The present invention provides an improved can end for attachment to a can body, said end being of the type described and claimed in U.S. Pat. No. 4,574,975 granted Mar. 11, 1986 and assigned to the same assignee as the present application. The disclosure of the aforesaid U.S. Pat. No. 4,574,975 is incorporated by reference herein and relied upon.

BACKGROUND OF THE INVENTION

As described in detail in the aforementioned U.S. Pat. No. 4,574,975, a number of prior art structures have been developed for the purpose of closing bottles and cans, whether of metal, plastic or glass, jars and others containers but few of such closure devices have been designed so that they can be refitted on a once opened container to reseal the dispensing opening and those that have had resealable features have often been difficult to manipulate by a user on the one hand, and, on the other, could not be usefully employed where the contents of the container were under pressure or were capable of generating pressure. This is of particular concern where a resealable closure is employed as there is always the possibility of injury where the closure device is improperly installed on the opening of the container unbeknown to the user. With the passage of time, pressure build-up can cause unexpected popping or "missileing" of the closure device which can result in injury to a user or bystander.

Another difficulty encountered in this field is the task of providing a closure that can be opened by the widest possible range of users. In this connection, a subsidiary but closely related problem is that of venting where the contents of the container are either at a vacuum or under pressure. In the former case, breaking the vacuum can make opening difficult particularly where any portion of a resealable closure acts as a plug in the container opening. In the latter case, internal pressure build-up can also force parts of the closure device to lock on the opening or an associated flange of the opening thus rendering it difficult for a number of users to remove the container closure. It is necessary, therefore, to provide a safe venting feature to any resealable container closure that is intended to be employed where the contents of the container will be at other than atmospheric pressure. The above-cited United States Patent refers to other criteria which resealable container closures must satisfy to enable them to be marketed in competition with other types of containers.

The present invention incorporates a number of the features of the aforementioned U.S. Pat. No. 4,574,975 but also provides an improved opening arrangement which will enable the closure device to be used on a container without regard to characteristics of the contents of the container.

In a preferred embodiment, the closure device for a can body is provided with a metallic end wall having an opening formed therethrough surrounded by an upwardly and outwardly flaring beaded flange of a structure similar to that disclosed in FIG. 11 of the aforementioned United States Patent. The flexible closure device which is preferably of molded plastic includes a central panel, a lever and a nose which acts as a connecting portion between the lever and the central panel substantially as in the embodiment described in the aforementioned U.S. Patent. In the present invention, the central panel has an inner annular skirt or ring portion which includes a peripheral surface which is spaced just inwardly of the interior surface of the beaded flange when the closure device is fitted on the beaded flange. The central panel is relieved or hollowed out in the area spaced inwardly of the peripheral surface of the ring portion so as to impart greater flexibility to the central panel especially during opening and closing of the end wall opening. With this arrangement, particularly where the contents of the container are under pressure, the peripheral surface of the ring portion will not normally engage to any significant extent the interior surface of the beaded flange when the closure device is fitted on the end wall to close the end wall opening. The nose portion located between the lever portion and the central panel engages the exterior of the beaded flange to retain the closure device in the opening of the end wall.

A pair of straps or handles are provided to facilitate lifting of the lever portion to commence removal of the closure device. In the present embodiment, with the lever portion in its downwardly extending position a user will pull on one of the straps or handles. Venting of the contents of the container such as a can body will commence as soon as a passage way is cleared between the outer surface of the flange and he nose portion. However, further pulling on the strap or handle will bring at least a portion of the peripheral surface of the ring portion into frictional engagement with a portion of the internal surface of the beaded flange to thereby provide resistance at least initially to further opening movement of the closure device. In this manner, relatively safe venting of the contents will occur while a retarding force is exerted by virtue of angular displacement of the ring portion. Additionally, flexing of the ring portion causes outward bulging of a section of the ring portion so that the adjacent peripheral surface engages the interior surface of the beaded flange. Continued upward pulling on the handle or pull tab will progressively move the bulging section on the internal surface of the beaded flange until the ring portion is clear or free of the beaded flange. A controlled venting is thus provided to thereby minimize the possibility of unwanted popping or blow out of the flexible closure device.

The present invention also provides an improved pull tab in the form of a generally U-shaped strap which is integrally molded with two spaced arms extending from the lever portion and with each strap being of substantial uniform thickness to avoid any abrupt transitions which could form weak points resulting in premature failure of the strap during use.

The foregoing and other advantages of the present invention will become apparent as consideration is given to the following detailed description taken in conjunction with the accompanying drawings wherein:

BRIEF DESCRIPTION OF THE DRAWINGS

FIG. 3 is a top plan view of the closure device and end wall of the present invention;

FIG. 5 is an enlarged sectional view of the flange of the end wall of this invention.

DETAILED DESCRIPTION OF THE PREFERRED EMBODIMENT

Figure 1:
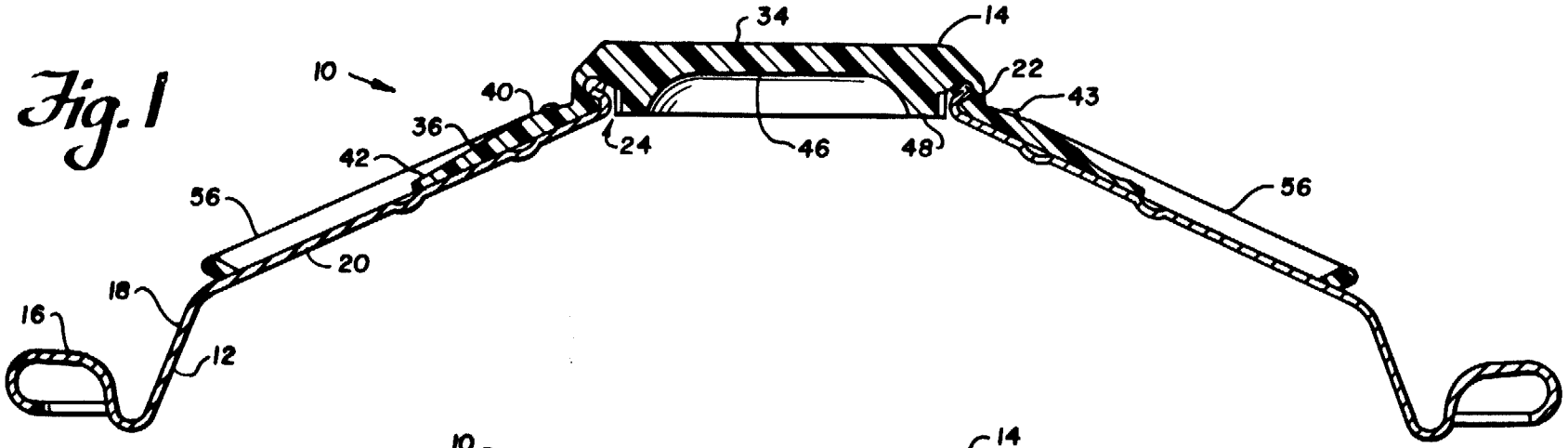
FIG. 1 is a side sectional view in elevation of the closure device and can end wall of the present invention.

Turning now to the figures, wherein like numerals designate corresponding parts throughout the several views, there is shown in FIGS. 1–4 the closure device 10 of the present invention which includes a metallic end wall 12 and a flexible closure element 14 which is preferably of molded plastic as described herein. The metallic end wall 12 preferably includes a curl 16 to enable the closure device to be double seamed to a can body according to the standard practice in this industry. It will be apparent that the curl 16 can be eliminated and that other alternatives for securing the end wall to a container body may be employed. For example, the end wall 12 could be adhesively secured to a can body.

As illustrated, the radially outer portion of the end wall has a steeply rising panel section 18 and an inner more gradually rising second panel section 20 which terminates at its radially innermost end in a circular beaded flange 22 surrounding an opening 24 which is concentric with the central axis of the end wall 12. The outer panel 18 will provide internal pressure resistance of the end walls as is conventional in can end making.

Figure 4:
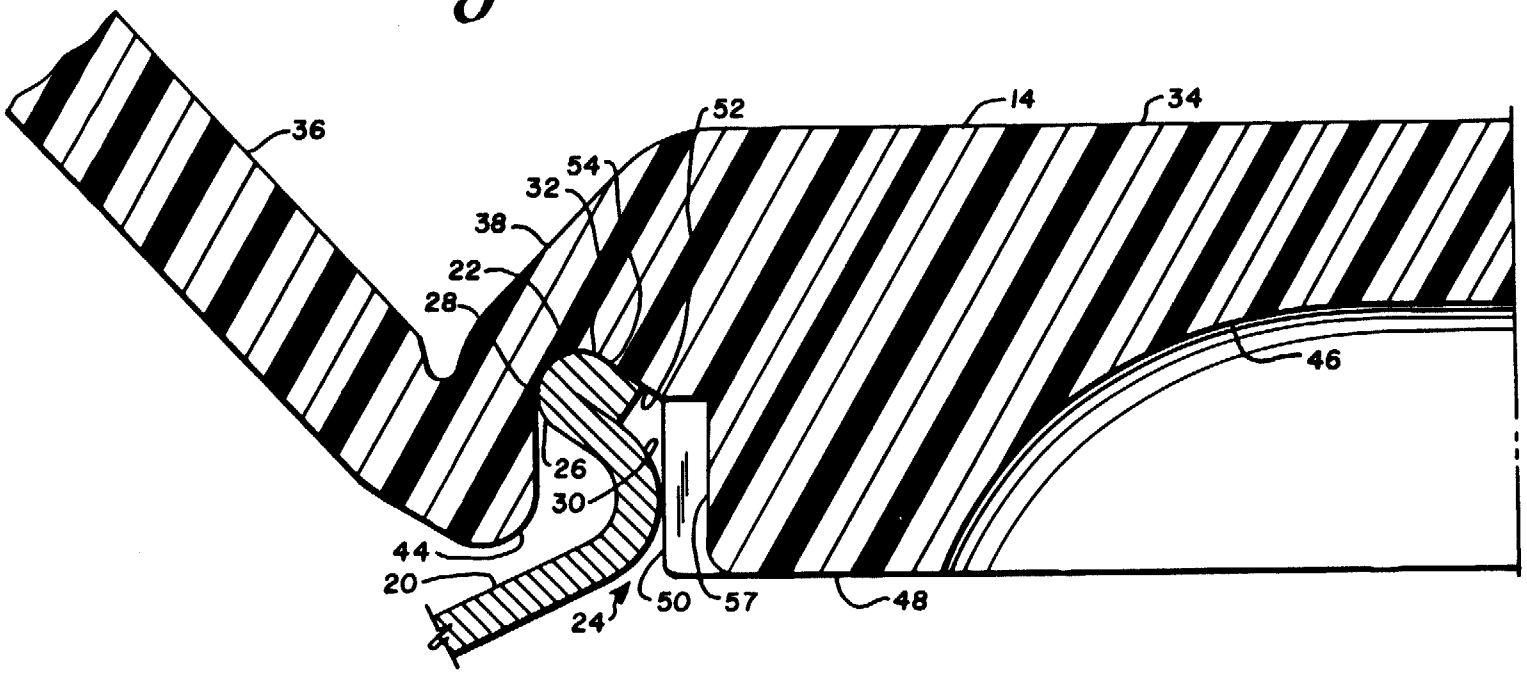
FIG. 4 is an enlarged detailed sectional view of a portion of the flexible closure device with the lever portion in an upwardly directed position.

As shown more clearly in FIG. 4, as formed the hemmed or beaded flange 22 extends upwardly and outwardly with respect to the opening 24 and includes an outer flange surface 26, a top flange surface 28 and an inner flange surface 30. The flange 22 is formed by beading or hemming metal as at 32 preferably inwardly, although outward hemming is also within the contemplation of the present invention.

The flexible closure element 14 is generally similar to that of the U.S. Pat. No. 4,574,975. In this regard, the closure element 14 includes a central closing wall or panel 34 and a generally frustoconical lever portion or skirt 36 and a connection portion 38 connecting the inner end of the lever portion with the central panel. The lever portion 36 may be formed with an inner annular section 40 of essentially constant thickness and an outer tapering section 42 of gradually diminishing thickness as illustrated. An annular ring 43 may be provided on the outer surface of lever portion 36 to aid in molding of the closure element 14. This annular ring 43 neither adds to nor detracts from the function of the lever portion 36.

The connection portion 38 includes a nose portion 44 formed at the inner end of the lever portion 36. The nose portion should have a diameter approximately equal to or slightly larger than the outer diameter of the flange 22 when the lever portion 36 is in its first or upward position as illustrated in FIG. 4. If desired, the diameter of the nose 44 may be slightly less than that of the beaded flange 22 to provide an interference fit which will facilitate high-speed application of the closure element to the flange.

It has been found that improved sealing of the closure element 14 to the metallic end wall 12 may occur if the closure element and/or the metallic end wall is heated, such as to a temperature between 95° and 200° F., as these components are assembled.

Permissible materials for the metallic end wall 12 include those materials typically used in can making, such as steel and aluminum alloys with the preference being for aluminum. The flexible closure element may be formed of rubber or a plastic resin, such as polypropylene, polyethylene, polypropylene-polyethylene copolymers and the like. Polypropylene is preferred.

To improve compatibility between the sealing surfaces of the metallic end wall and the closure element, a surface coating may be placed on the sealing surfaces of the metallic end wall and/or closure element. Typical of such material are waxes, laquers and the like. If necessary to reduce the gas transmission rate of the closure element, this element may be coated with a low gas transmission rate material, such as polyvinylidene chloride (PVDC) or ethylene vinyl alcohol (EVOH).

As shown more clearly in FIG. 4, the surface 46 of the central panel 34 that faces inwardly of a container when the end wall is affixed to a container body is provided with a depending skirt o annular ring portion 48 which has an outer peripheral surface 50. In a preferred embodiment, the outer peripheral surface 50 of the ring portion tapers inwardly toward the central axis of the central panel 34 as its distance from inner wall 52 increases. The angle of taper should be in the range of about 0.5 to 2.0 degrees. In a preferred embodiment, this peripheral surface 50 of the ring portion 48 does not contact any portion of the interior surface of the beaded flange 22 at least when the central panel 34 is in an unstressed or unflexed condition. Thus, when a user places the closure device 10 on the flange 22 of the end wall 12 of a container, with the lever portion 36 in the upwardly extending position, the peripheral surface 50 of the ring portion 48 will not plug the opening 24 surrounded by the beaded flange 22. Thus any pressure build-up from the contents of the can will result in slight movement of the closure device upwardly to self vent the interior of the can. With the lever portion 36 of moved downwardly to the condition shown in FIG. 1 the nose portion 44 will engage under the exterior of the beaded flange 22 to prevent removal of the closure device 14 as a result of pressure build up within the container.

Also, as best seen in FIG. 4, the hemmed flange 32 is at an angle which may be equal to o greater than the angle of surface 52 of closure element 14. Preferably, the angle of hemmed flange 32 is greater than that of surface 52. If, however, these angles are equal, contact between surfaces 52 and 32 may occur as the closure device 10 is formed. When the closure device 10 is placed on a container and its contents are pressurized, the internal pressure acting o the central panel 34 lifts surface 52 off of surface 32, permitting proper venting of the closure device 10 as the closure device is opened.

As has previously been noted, the closure element 14 is molded from a plastic such as polypropylene. As in the above-cited patent, the lever portion 36 is molded in an upright or "reverse umbrella" position. As the lever portion 36 is moved downwardly in fitting the closure element 14 on the can end wall 12, internal forces caused by the movement of the lever portion 36 from its initially molded upright position to the horizontal and over center and downwardly past the horizontal, creates tension within the lever portion 36 which acts to pull the lever portion 36 and nose 44 closer to the central panel 34 and with the beaded flange 22 interposed in the annular recess 54, the sealing function against the exterior surface 26 of the flange 22 is provided.

As shown in FIG. 1, the closure device 14 is fully sealed onto the metallic end wall with the nose 44 in sealing engagement with the outer surface 26 of the beaded flange 22. In the illustrated embodiment, the nose 44 of the closure device fully occupies the space between the exterior surface of the flange 22 and the tapering, adjacent panel section 20. With this arrangement, the effects of natural plastic deformation will be minimized so that continued removal and resealing of the opening of the end wall can be effected.

In the completely sealed position, as illustrated in FIG. 1, there remains tension within the lever portion 36. The lever portion 36, after passing the horizontal or over-center position, does not return to an untensioned, as-molded "reverse umbrella" position. This residual tension in the lever portion 36 helps maintain the tight seal between the nose 44 and the outer surface 26 of the flange 22. The residual tension results, at least in part, from the inability of the lever portion 36 to rotate downwardly farther due to its firm contact with the end wall section 20. This firm contact between the lever portion 36 and the metallic end wall 20 prevents the ingress of dirt and debris thereby avoiding the possibility of contamination to the contents of the container.

Preferably, sealing contact with the beaded flange is primarily about the exterior surface 26 of the beaded flange 36 as illustrated in FIG. 1. With this arrangement, upon lifting of one the pull straps 56, the lever portion 36 attached adjacent thereto will be lifted to pull the associated adjacent nose 44 out of contact with the beaded flange 22. Separation of the nose 44 from the exterior surface 26 of the flange 22 will commence a controlled venting while continued pulling up on the strap 56 will pull the remaining portion of the lever portion 30 to the inverted umbrella condition. Any flexing of the ring portion 48 will aid the frictional engagement of the peripheral surface 50 of the ring portion 48 located internally of the flange 22 to thereby effectively prevent blowing off of the closure device 14 during the venting. Pulling up another portion of the lever portion 36 by pulling o the other handle or strap 56 will eventually effect complete reversal of the lever portion to the upwardly extending condition. The user may then simply lift the closure device 14 from the metallic end 12. By forming the closure device 14 so that the ring portion 48 does not form a plug with the interior surface 30 of the beaded flange 22, uncontrolled venting is avoided which can result in blowing off of the closure device which is not acceptable.

Figure 2:
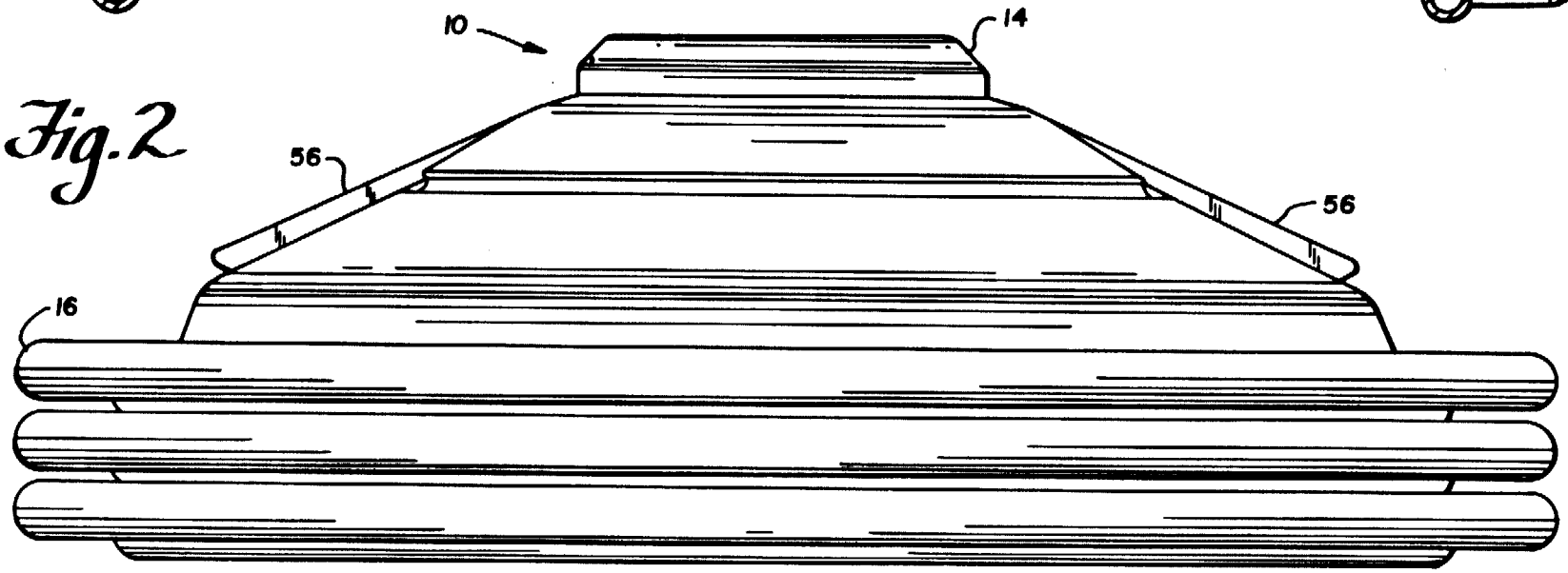
FIG. 2 is a side view in elevation showing a stacked arrangement of the end wall and closure device of the present invention.

As shown in FIG. 2, the end wall 12 of the present invention carrying a closure device 14 is stackable due primarily to the close conformity of the closure device 14 to the end wall 12 when installed o the opening of an end wall.

With reference again to FIG. 4, there is shown a greatly enlarged detailed sectional view of the flange of the metallic end wall with the flexible closure element fitted thereon. As with the aforementioned United States patent, in manufacturing the beaded flange, certain relationships are important.

Firstly, before the opening is formed, the end wall is in the form of a single disc of metal which, after passing through a number of die forming steps is placed in condition for forming the opening. Prior to forming the opening, the area in which the metal is removed to form the opening is preferably subjected to a coining, operation which involves compressing the metal between dies whereby the metal of the region adjacent the end face will be stress relieved and reduced in transverse thickness. As a result of the coining, the metal becomes more resistant to fracturing during the subsequent forming steps. In forming the opening, it is important that the surfaces of the flange be smoothly formed.

Also, it is found that angle A, (FIG. 5) the angle at which the smooth annular surface extends upwardly from the plane surface indicated in the broken line at 58 should be between about 30° and about 40° and preferably about 35°. The plane indicated at 58 is that plane which passes through an annular region defined by the smallest diameter of the neck in the opening 24. It is been found that where the annular relationship is maintained, the flexible closure element 14 is retained in sealing engagement with the flange 22 at unexpectedly high pressures and, in some instances, the closure element remains in place on the flange even after the metal of the container has failed due to excess pressure. Where the angle A is less than about 30°, it becomes difficult to remove the closure element from the metallic end and where the angle A is greater than about 40° and where the contents of the container are pressurized, the flexible closure element exhibits a tendency to slide over the flange 22.

With reference to FIGS. 1, 4 and 5, it will be appreciated that the upper end of the beaded flange 22 includes a rounded portion 28 which cooperates with the outer curved portion of the recess 54 on the interior of the connecting portion 38 of the flexible closure element. Ideally, these surfaces are substantially complementary configurations in size, shape and curvature. As a result, when the closure element is installed on tee flange of the end wall, there will be substantially full and complete contact between the rounded surface of the closure element and the surface 28 of the flange 22 upon initial positioning of the closure element over tee opening prior to inverting the lever portion as shown in FIG. 4 to the generally downwardly directed position as shown in FIG. 1.

FIG. 5 illustrates angle B which is the angle between plane 58 and the upwardly and inwardly directed panel 20. This angle B should range between about 25° and about 35° and preferably is about 25°. If the angle B exceeds about 35°, stackability of the closure device is impaired and if the angle B is less than about 25°, pourability through the metallic end suffers. The combined angle formed by angles A and B would thus be in the range of about 55° to about 75° and preferably would be about 60°.

With reference to that of FIG. 3, there is illustrated a top plan view showing the disposition of one of the looped pull straps 56 of the present invention, it being understood that a complementary pull strap is located on the opposite side as the closure device is symmetrical about the center line of FIG. 3.

The pull strap 56 has integral connection portions 60, 62 spaced approximately 50° apart to provide optimal leverage and with the arms 64, 66 extending from their respective integral attachment portions 60, 62 slightly outwardly of a radial line to provide a larger handle opening. The attachment portions are molded at a uniform thickness to avoid any abrupt variations which could form the focus of a tear or separation point in the straps after a number of uses. The diversions of the arm portions of each loop is approximately at a 15° angle outwardly of the attachment portion of each of the associated arms of the strap. Preferably, at least the arms 64, 66 of the straps are polygonally shaped with tapering side walls.

As an additional venting aid, one or more vent slots 57 may be provided. As shown, these vent slots 57 are centered on straps 56, but they may alternately be provided at each attachment point or even as a series of serrations completely surrounding skirt 48.

To avoid injury to the finger of the user due to contact with the outer rim of the lever portion, a reduced thickness section 59 may be provided as indicated in FIG. 3.

The entire closure device 14 including the pull straps 56 may be injection molded. Preferably, the closure element is made of a relatively stiff polypropylene such as that currently available from Himont, and identified by that company as Himont 6329 or a polyallomer of polypropylene and ethylene from Eastman Kodak and identified by that company as TENITE 5020.

While the closure device of the present invention has been described with reference to certain specific embodiments, it will be understood by those skilled in the art that various modifications may be made therein without departing from the scope of this invention as defined in the accompanying claims.

What is claimed is:

1. A closure device for a can comprising a metallic end wall having an opening therethrough and a flexible closure element, said opening being substantially surrounded by a beaded flange means that flares outwardly relative to said opening, said beaded flange means including an exterior surface portion, said end wall including a wall portion surrounding said flange means with said wall portion extending at a selected angle relative to said exterior surface portion of said flange means, said flexible closure element having a central panel, a lever portion and a connecting portion connecting said central panel with said lever portion, said lever portion being initially positioned in a first position, when said central panel is generally horizontally disposed, as a generally upwardly directed frustoconical skirt portion and having, as viewed in vertical cross-section, a nose at its connection with said connecting portion, said metallic end wall and said closure element being constructed and arranged such that, upon positioning said closure element over said opening of said metallic end wall and moving said lever portion to a second position including, when said central panel is generally horizontally disposed, moving said lever portion to a generally downwardly directed position, said nose portion will sealingly engage at least a continuous annular part of said exterior surface portion of said flange means, said central panel including a first surface and a second surface each disposed so that, when said closure element is fitted on said flange means of said opening of said end wall and said lever means is in said second position and said end wall is mounted on a can body, said first surface will face outwardly of said opening and said second surface will face inwardly, said second surface including removal retarding means for frictionally engaging at least a portion of said flange means at least as said closure element is being removed from said opening to thereby provide a resistance to removal of said closure device at least until said retarding means is free of said flange means, said wall portion of said metallic end wall having a substantially frustoconical annular section extending outwardly from said flange means and said lever portion having a smooth surfaced section which intimately engages said substantially frustoconical annular section of said end wall when said lever portion is moved to said second position so as to substantially prevent ingress of dirt and the like between said lever portion in said second position and said annular section of said wall portion.

2. A closure device for a can comprising a metallic end wall having an opening therethrough and a flexible closure element, said opening being substantially surrounded by a beaded flange means that flares outwardly relative to said opening, said flange means including an exterior surface portion, said end wall including a wall portion surrounding said flange means with said wall portion extending at a selected angle relative to said exterior surface portion of said flange means, said selected angle between said wall portion and said exterior surface portion of said flange means lying within the range of about 55 degrees 75 degrees ;

said flexible closure element having a central panel, a lever portion and connecting portion connecting said central panel with said lever portion, said lever portion being initially positioned in a first position, when said central panel is generally horizontally disposed, as a generally upwardly directed frustoconical skirt portion and having, as viewed in vertical cross-section, a nose at its connection with said connecting portion, said metallic end wall and said closure element being constructed and arranged such that, upon positioning said closure element over said opening of said metallic end wall and moving said lever portion to a second position including, when said central panel is generally horizontally disposed, moving said lever portion to a generally downwardly directed position, said nose portion will sealingly engage at least continuous annular part of said exterior surface portion of said flange means, said central panel including a first surface and a second surface each disposed so that, when said closure element is fitted on said flange means of said opening of said end wall and said lever means is in said second position and said end wall is mounted on a can body, said first surface will face outwardly of said opening and said second surface will face inwardly, said second surface including removal retarding means for frictionally engaging at least a portion of said flange means at least as said closure element is being removed from said opening to thereby provide a resistance to removal of said closure device at least until said retarding means is free of said flange means.

3. A closure device for a can comprising a metallic end wall having an opening therethrough and a flexible closure element, said opening being substantially surrounded by a beaded flange means that flares outwardly relative to said opening, said flange means including an exterior surface portion, said end wall including a wall portion surrounding said flange means with said wall portion extending at a selected angle relative to said exterior surface portion of said flange means, said flexible closure element having a central panel, a lever portion and a connecting portion connecting said central panel with said lever portion, said lever portion being initially positioned in a first position, when said central panel is generally horizontally disposed, as a generally upwardly directed frustoconical skirt portion and having, as viewed in vertical cross-section, a nose at its connection with said connection portion, said metallic end wall and said closure element being constructed and arranged such that, upon positioning said closure element over said opening of said metallic end wall and moving said lever portion to a second position including, when said central panel is generally horizontally disposed, moving said lever portion to a generally downwardly directed position, said nose portion will sealingly engage at least a continuous annular part of said exterior surface portion of said flange means, said central panel including a first surface and a second surface each disposed so that, when said closure element is fitted on said flange means of said opening of said end wall and said lever means is in said second position and said end wall is mounted on a can body, said first surface will face outwardly of said opening and said second surface will face inwardly, said second surface including removal retarding means for frictionally engaging at least a portion of said flange means at least as said closure element is being removed from said opening to thereby provide a resistance to removal of said closure device at least until said retarding means is free of said flange means, said opening of said end wall having a neck portion of minimum diameter relative to other portions of said opening, said exterior surface portion of said flange means extending at a selected angle of between about 30 degrees and about 40 degrees to a plane passing through said neck portion.

4. A closure device for a can comprising a metallic end wall having an opening therethrough and a flexible closure element, said opening being substantially surrounded by a beaded flange means that flares outwardly relative to said opening, said flange means including an exterior surface portion, said end wall including a wall portion surrounding said flange means with said wall portion extending at a selected angle relative to said exterior surface portion of said flange means, said flexible closure element having a central panel, a lever portion and a connecting portion connecting said central panel with said lever portion, said lever portion being initially positioned in a first position, when said central panel is generally horizontally disposed, as a generally upwardly directed frustoconical skirt portion and having, as viewed in vertical cross-section, a nose at its connection with said connecting portion, said metallic end wall and said closure element being constructed and arranged such that, upon positioning said closure element over said opening of said metallic end wall and moving said lever portion to a second position including, when said central panel is generally horizontally disposed, moving said lever portion to a generally downwardly directed position, said nose portion will sealingly engage at least a continuous annular part of said exterior surface portion of said flange means, said central panel including a first surface and a second surface each disposed so that, when said closure element is fitted on said flange mean of said opening of said end wall and said lever means is in said second position and said end wall is mounted on a can body, said first surface will face outwardly of said opening and said second surface will face inwardly, said second surface including removal retarding means for frictionally engaging at least a portion of said flange means only as said closure element is being removed from said opening to thereby provide a resistance to removal of said closure device at least until said retarding means is free of said flange means.

5. The invention as claimed in claim 1,2,3 or 4, wherein said metallic end wall is formed from a steel alloy.

6. The invention as claimed in claim 1, 2, 3 or 4 wherein said flange means of said metallic end wall includes a bent over end section with the end section extending in the direction of said opening.

7. The invention as claimed in claims 1, 2, 3 or 4 wherein said lever portion has an outer periphery and at least one pull tab is connected to said outer periphery of said lever portion.

8. The invention as claimed in claim 7, wherein said pull tab has means for indicating tampering therewith.

9. The invention as claimed in claim 2, wherein said selected angle is approximately 60 degrees.

10. The invention as claimed in claim 3 wherein said selected angle is approximately 35 degrees.

11. The closure device of claim 1, 2, 3 or 4 wherein said metallic end is formed from an aluminum alloy.

12. The closure device of claim 1, 2, 3 or 4, wherein said flexible closure element is formed from polypropylene.

13. The closure device of claim 1, 2, 3 or 4, wherein said flexible closure element is formed from polyethylene.

14. The closure device of claim 1, 2, 3 or 4 wherein the surfaces of said metallic end wall includes a coating thereon.

15. The closure device of claim 14 wherein said coating comprises a wax or lacquer.

16. The closure device of claim 1, 2, 3 or 4 wherein said closure element is coated with a low gas transmission rate coating material.

17. The closure device of claim 16 wherein said coating material comprises polyvinylidene chloride.

18. The closure device of claim 16 wherein said coating material comprises ethylene vinyl alcohol.

19. The closure device of claim 1, 2, 3 or 4 wherein said end wall includes means for attachment comprising a curl.

20. The closure device of claim 1, 2, 3 or 4 wherein said end wall has means for attachment comprising a surface which may be adhesively bonded to a can.

21. The closure device of claim 1, 2, 3 or 4 wherein said flange means is inwardly beaded.

22. The closure device of claim 1, 2, 3 or 4 wherein said lever portion is of increasing thickness in a radial inner segment and of decreasing thickness in a radial outer segment.

23. The closure device of claim 1, 2, 3 or 4 wherein said metallic end wall is heated prior to assembly of said closure device.

24. The closure device of claim 1, 2, 3 or 4 wherein said closure element is heated prior to installation on said end wall.

25. The invention of claim 24 wherein said closure element is heated to a temperature between about 95 and 120 degrees F.

26. A closure device for a can comprising a metallic end wall having an opening therethrough and a flexible closure element, said opening being substantially surrounded by a beaded. flange means that flares outwardly relative to said opening, said beaded flange means including an exterior surface portion, said end wall including a wall portion surrounding said flange means with said wall portion extending at a selected angle relative to said exterior surface portion of said flange means, said flexible closure element having a central panel, a lever portion and a connecting portion connecting said central panel with said lever portion, said lever portion being initially positioned in a first position, when said central panel is generally horizontally disposed, as a generally upwardly directed frustoconical skirt portion and having, as viewed in vertical cross-section, a nose at its connection with said connecting portion, said metallic end wall and said closure element being constructed and arranged such that, upon positioning said closure element over said opening of said metallic end wall and moving said lever portion to a second position including, when said central panel is generally horizontally disposed, moving said lever portion to a generally downwardly directed position, said nose portion will sealingly engage at least a continuous annular part of the said exterior surface portion of said flange means, said central panel including first surface and a second surface each disposed so that, when said closure element is fitted on said flange means of said opening of said end wall and said lever means is in said second position and said end wall is mounted on a can body, said first surface will face outwardly of said opening and said second surface will face inwardly, said second surface including removal retarding means for frictionally engaging at least a portion of said flange means at least as said closure element is being removed from said opening to thereby provide a resistance to removal of said closure device at least until said retarding means is free of said flange means, said beaded flange means including a rounded portion and said closure element including a surface that is of substantially complementary configuration in size, shape and curvature to said rounded portion so that said rounded portion and said surface on said closure element are in substantially full and complete contact with each other upon initial positioning of said closure element over said opening prior to inverting said lever portion to a generally downwardly directed position.

27. A closure device for a can comprising a metallic end wall having an opening therethrough and a flexible closure element, said opening being substantially surrounded by a beaded flange means that flares outwardly relative to said opening, said beaded flange means including an exterior surface portion, said end wall including a wall portion surrounding said flange means with said wall portion extending at a selected angle relative to said exterior surface portion of said flange means, said flexible closure element having a central panel, a lever portion and a connecting portion connecting said central panel with said lever portion, said lever portion being initially positioned in a first position, when said central panel is generally horizontally disposed, as a generally upwardly directed frustoconical skirt portion and having, as viewed in vertical cross-section, a nose at its connection with said connecting portion, said metallic end wall and said closure element being constructed and arranged such that, upon positioning said closure element over said opening of said metallic end wall and moving said lever portion to a second position including, when said central panel is generally horizontally disposed, moving said lever portion to a generally downwardly directed position, said nose portion will sealingly engage at least a continuous annular part of the said exterior surface portion of said flange means, said central panel including a first surface and a second surface each disposed so that, when said closure element is fitted on said flange means of said opening of said end wall and said lever means is in said second position and said end wall is mounted on a can body, said first surface will face outwardly of said opening and said second surface will face inwardly, said second surface including removal retarding means for frictionally engaging at least a portion of said flange means at least as said closure element is being removed from said opening to thereby provide a resistance to removal of said closure device at least until said retarding means is free of said flange means, said metallic end wall having a substantially frustoconical annular section extending outwardly from said flange means and said lever portion having a smooth surfaced section which intimately engages said substantially frustoconical annular section of said end wall when moved to said second position so as to substantially prevent ingress of dirt and the like between said lever portion in said second position and said annular section of said end wall, said opening of said end wall having a neck portion of minimum diameter relative to other portions of said opening, said exterior surface portion of said flange means extending at a selected angle of between about 30 and about 40 degrees to a plane passing through said neck portion.

28. A closure device for a can, said closure device comprising a metallic end and a flexible closure element, said metallic end having an opening therein bounded by an outwardly and upwardly flaring beaded flange and having means adjacent its periphery for attachment to said can, said metallic end including an upwardly and inwardly tapering section between said means and said flange, said flexible closure element having a central panel, a lever portion and a connecting portion connecting said central panel and said lever portion, said lever portion being initially positioned as a generally upwardly directed frustoconical portion or skirt and having, as viewed in vertical cross-section, a nose at its connection with said connecting portion, said metallic end and said closure element being constructed and arranged such that upon positioning said closure element over said opening in said metallic end and inverting said lever portion to a generally downwardly directed position said nose portion sealingly contacts the outer surface of said flange without mechanically hooking under the outer surface of said flange and said connecting portion sealingly contacts said flange in a tangential relationship defined between said central panel and said flange while said lever portion abuts against said tapering section of said metallic end, said central panel including a first surface and a second surface each disposed so that, when said closure element is fitted on said flange means of said opening of said end and said lever means is in said second position and said end is mounted on a can body, said first surface will face outwardly of said opening and said second surface will face inwardly, said second surface including removal retarding means for frictionally engaging at least a portion of said flange means only as said closure element is being removed from said opening to thereby provide a resistance to removal of said closure device at least until said removal retarding means is free of said flange means.

29. The closure device of claim 28 wherein the upper end of said beaded flange includes a rounded portion and said closure element includes a surface that is of substantially complementary configuration in size, shape and curvature to said rounded portion so that said rounded portion and said surface on said closure element are in substantially full and complete contact with each other upon the initial positioning of said closure element over said opening prior to inverting said lever portion to a generally downwardly directed position.

30. The closure device of claim 29 wherein, when viewed in vertical cross-section, the surface of said beaded flange immediately below said rounded portion is a straight line, and the surface of said closure element immediately below said complementary portion thereof is also a straight line, whereby said inverting brings the two straight line surfaces into contact with each other without any substantial sliding therebetween.

31. The closure device of claim 28 wherein said metallic end is formed from an aluminum alloy.

32. The closure device of claim 28, wherein said flexible closure element is formed from polypropylene.

33. The closure device of claim 28, wherein said flexible closure element is formed from polyethylene.

34. The closure device of claim 28 wherein the surfaces of said metallic end wall includes a coating thereon.

35. The closure device of claim 34 wherein said coating comprises a wax or lacquer.

36. The closure device of claim 28 wherein said closure element is coated with a low gas transmission rate coating material.

37. The closure device of claim 36 wherein said coating material comprises polyvinylidene chloride.

38. The closure device of claim 36 wherein said coating material comprises ethylene vinyl alcohol.

39. The closure device of claim 28 wherein said end wall includes means for attachment comprising a curl.

40. The closure device of claim 28 wherein said end wall has means for attachment comprising a surface which may be adhesively bonded to a can.

41. The closure device of claim 28 wherein said flange means is outwardly beaded.

42. The closure device of claim 28 wherein said lever portion is of increasing thickness in a radial inner segment and of decreasing thickness in a radial outer segment.

43. The closure device of claim 28 wherein said metallic end wall is heated prior to assembly of said closure device.

44. The closure device of claim 28 wherein said closure element is heated prior to installation on said end wall.

45. The invention of claim 44 wherein said closure element is heated to a temperature between about 95 and 120 degrees F. (35 and 65.6 C.).

46. The closure device as claimed in claim 1,2,3,4,26, 27 or 28, wherein said end wall is adapted to be attached to a can body and said removal retarding means is out of contact with a sufficient portion of said flange means when said lever portion is in said second position so that said closure element is movable relative to said opening in response to a predetermined pressure existing in the can body.

47. The closure device as claimed in claim 1,2,3,4,26, 27 or 28, wherein said removal retarding means includes peripheral surface means extending from said second surface of said central panel located relative to said flange means so that as said central panel is flexed upon removal of said closure element from said opening at least a portion of said peripheral surface means frictionally engages said flange means.

48. The closure device as claimed in claim 1,2,3,4,26, 27 or 28, wherein said peripheral surface means is formed as an annular ring portion on said second surface.

49. The closure device as claimed in claim 48, wherein said ring portion surrounds a hollowed out section of said central panel.

50. The closure device as claimed in claim 47, wherein said peripheral surface means includes pressure venting means.

51. The closure device as claimed in claim 50, wherein said pressure venting means comprises at least one groove formed in said peripheral surface means and extending generally transverse to said central panel.

52. The closure device as claimed in claim 47, wherein said peripheral surface means extends from an annular wall which is spaced inwardly of said connecting portion and which extends radially outwardly of said peripheral surface means.

53. The closure device as claimed in claim 1, 2, 3, 4, 26, 27 or 28 wherein said lever portion at a radially outer section tapers to become thinner as the radial distance from said central panel increases and strap means are provided which is formed integrally with a portion of said radially outer section of said lever portion.

54. The closure device as claimed in claim 53 wherein said strap means includes at least one loop having two spaced arms with each arm having an end formed integrally with said radially outer section of said lever portion.

55. The closure device as claimed in claim 54 wherein said arms at their points of juncture with said lever portion are spaced apart approximately 50 degrees.

56. The closure device as claimed in claim 55 wherein said arms diverge with respect to each other outwardly of said points of juncture at an additional angle of approximately 15 degrees.

57. The closure device as claimed in claim 54 wherein said arms are of substantially uniform thickness along their respective lengths.

58. The closure device as claimed in claim 53 wherein two strap means are provided spaced from each other about the lever portion.

59. The closure device as claimed in claim 1, 2, 3, 4, 26, 27 or 28 wherein said second surface includes peripheral surface means and said peripheral surface means includes slot mean for venting the contents of the can body when said closure device is removed.

60. The closure device as claimed in claim 59 wherein said slot means comprises a plurality of recesses formed in said peripheral surface and spaced about said peripheral surface.

61. The closure device as claimed in claim 59 wherein said slot means is located on said peripheral surface adjacent tab means carried on said lever portion.

62. The closure device as claimed in claim 54 wherein said lever portion has a reduced thickness portion between the points where said arms join said radially outer section of said lever portion.

* * * * *